US007135516B2

(12) United States Patent
Sugiura et al.

(10) Patent No.: US 7,135,516 B2
(45) Date of Patent: Nov. 14, 2006

(54) SIZING AGENT FOR CARBON FIBER, METHOD FOR SIZING CARBON FIBER BY SAID SIZING AGENT, SIZED CARBON FIBER AND KNITTED OR WOVEN FABRIC USING SAID CARBON FIBER

(75) Inventors: Naoki Sugiura, Ichinomiya (JP); Norihito Maki, Toyohashi (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 52 days.

(21) Appl. No.: 10/484,803

(22) PCT Filed: Jul. 30, 2002

(86) PCT No.: PCT/JP02/07728

§ 371 (c)(1),
(2), (4) Date: Jan. 29, 2004

(87) PCT Pub. No.: WO03/012188

PCT Pub. Date: Feb. 13, 2003

(65) Prior Publication Data

US 2004/0197555 A1 Oct. 7, 2004

(30) Foreign Application Priority Data

Jul. 31, 2001 (JP) ..... 2001-232410

(51) Int. Cl.
*C08K 3/26* (2006.01)
*C08G 69/26* (2006.01)
*C08G 3/00* (2006.01)

(52) U.S. Cl. ..... 524/424; 524/606; 428/364; 428/367; 428/375; 428/408

(58) Field of Classification Search ..... 524/424, 524/606; 428/364, 367, 375, 408
See application file for complete search history.

(56) References Cited

U.S. PATENT DOCUMENTS 6,368,712 B1 * 4/2002 Kobayashi et al. ..... 428/367
6,638,615 B1 * 10/2003 Kobayashi et al. ..... 428/367

FOREIGN PATENT DOCUMENTS

| | | |
|---|---|---|
| JP | 60-221346 | 11/1985 |
| JP | 61-28074 | 2/1986 |
| JP | 1-272867 | 10/1989 |
| JP | 5-106164 | 4/1993 |
| JP | 7-009444 | 1/1995 |
| JP | 9-3777 | 1/1997 |
| JP | 2000-54269 | 2/2000 |

* cited by examiner

*Primary Examiner*—Kriellion Sanders
(74) *Attorney, Agent, or Firm*—Oblon, Spivak, McClelland, Maier & Neustadt, P.C.

(57) ABSTRACT

The present invention relates to a carbon fiber sizing agent comprised of water-soluble thermoplastic resin and amphoteric surfactant within a weight ratio range of 6/1 to 1/3, a carbon fiber sizing method comprising treating carbon fibers using a sizing liquid containing the aforementioned sizing agent, sized carbon fibers comprising adhering the aforementioned sizing agent to their surfaces, and a fabric that uses said carbon fibers. The carbon fiber sizing agent of the present invention has satisfactory solubility in water over a wide pH range, and is able to impart to carbon fibers adequate convergence for forming stable chopped carbon fibers, superior workability and satisfactory uniform tow dispersibility in water over a wide pH range. Since a fabric of the present invention demonstrates affinity to water over a wide pH range, it is suitable for applications such as immersing said fabric in an aqueous matrix in order to impregnate the fabric with that matrix.

8 Claims, No Drawings

SIZING AGENT FOR CARBON FIBER, METHOD FOR SIZING CARBON FIBER BY SAID SIZING AGENT, SIZED CARBON FIBER AND KNITTED OR WOVEN FABRIC USING SAID CARBON FIBER

TECHNICAL FIELD

The present invention relates to a carbon fiber sizing agent, a carbon fiber sizing method using said sizing agent, sized carbon fibers and fabrics using said carbon fibers.

BACKGROUND ART

Carbon fibers used as reinforcing fibers and so forth of fiber-reinforced composite are fibers in which no less than 90 weight % of the chemical composition is composed of carbon, and which are produced by using regenerated cellulose, polyacrylonitrile (PAN) or pitch and so forth as starting material. These carbon fibers are divided into, for example, high-strength carbon fibers, high-modulus carbon fibers and so forth.

Since carbon fibers are lightweight, have particularly superior properties with respect to specific strength and specific modulus and also have superior heat resistance and chemical resistance, they are particularly effective as reinforcing fibers of fiber-reinforced composite, and are used over a wide range of applications.

In addition, resin compounds such as epoxy resin or inorganic compounds such as cement and ceramics are used for the matrix of fiber-reinforced composite using carbon fibers as reinforcing fibers, and fiber-reinforced composite are formed that have superior mechanical properties.

In recent years, carbon fibers have also come to be used as reinforcing fibers of short-fiber reinforced composite materials. For example, after chopping carbon fibers into the form of chopped carbon fibers, they are dispersed in water to produce paper containing randomly dispersed chopped carbon fibers and so forth. In addition, chopped carbon fibers are also uniformly mixed and stirred into an inorganic matrix slurry such as concrete to produce a short-fiber reinforced composite in which chopped carbon fibers are randomly dispersed.

In order to obtain chopped carbon fibers for use in these applications, carbon fibers are typically treated with a water-soluble sizing agent followed by chopping. Preferable sizing agents used for this purpose are provided with superior solubility in water, while also being able to impart both the necessary convergence required for forming stable chopped carbon fibers as well as superior uniform tow dispersibility in water to the carbon fibers.

In addition, there are also many applications in which fabrics using carbon fibers are suspended in water or immersed in an aqueous matrix to impregnate with that matrix. Carbon fibers used in these applications are required to have superior workability (e.g., processability) when in the form of a fabric and superior uniform tow dispersibility in water. Treatment using a water-soluble sizing agent is also carried out to obtain carbon fibers provided with these properties.

Here, examples of known sizing agents include sizing agents composed of bisphenol type polyalkylene ether epoxy compounds (Japanese Unexamined Patent Application, First Publication No. Sho 61-28074), sizing agents composed of compounds in which several ten molecules of alkylene oxide are added to bisphenol A (Japanese Unexamined Patent Application, First Publication No. Hei 1-272867, Japanese Unexamined Patent Application, First Publication No. 7-9444), polyvinyl alcohol and water-soluble thermoplastic resins such as water-soluble Nylon resin (Japanese Examined Patent Application, Second Publication No. Hei 5-4348 or Japanese Patent Publication No. 2838309).

However, conventional sizing agents have the problems described below.

The sizing agents composed of bisphenol type polyalkylene ether epoxy compounds indicated in Japanese Unexamined Patent Application, First Publication No. Sho 61-28074 have comparatively satisfactory converging performance and allow the obtaining of carbon fibers having superior processability and other workability when formed into chopped carbon fibers or fabrics as a result of providing a glycidyl group in the compound serving as said sizing agent. However, these sizing agents have the disadvantages of being sticky due to the glycidyl group present in the compound, having inadequate solubility in water, and preventing the obtaining of carbon fibers having satisfactory uniform tow dispersibility in water.

On the other hand, sizing agents composed of a compound in which several ten molecules of alkylene oxide are added to bisphenol A indicated in Japanese Unexamined Patent Application, First Publication No. Hei 1-272867 and Japanese Unexamined Patent Application, First Publication No. Hei 7-9444 is able to impart superior uniform tow dispersibility in water to carbon fibers as a result of having superior solubility in water.

However, since this type of sizing agent composed of a compound containing ethylene oxide has somewhat weak converging performance that can be imparted to carbon fibers, in order to obtain carbon fibers having adequate convergence required for forming stable chopped carbon fibers and superior processability and other workability when forming into fabrics, it has the disadvantage of requiring a large amount of sizing agent to be adhered to the carbon fibers. In addition, the stickiness of this type of sizing agent increases as a result of adsorbing moisture in the air due to the presence of hydrophilic groups such as ($—CH_2—CH_2—O—$) in its molecules thereby resulting in sticking which lowers the processability and other workability of the carbon fibers when formed into fabrics. Consequently, in the case of using this type of sizing agent, the amount of sizing agent adhered must be strictly controlled in order to provide satisfactory processability and other workability to the resulting carbon fiber bundles, thereby increasing the complexity of the production process.

Moreover, sizing agents composed of polyvinyl alcohol or a water-soluble thermoplastic resin such as water-soluble Nylon resin indicated Japanese Examined Patent Application, Second Publication No. Hei 5-4348 or Japanese Patent Publication No. 2838309 have superior solubility in water as well as satisfactory converging performance. Consequently, they are able to impart adequate convergence required for forming into stable chopped carbon fibers as well as superior processability and other workability when forming into fabric to the carbon fibers. However, although carbon fibers imparted with polyvinyl alcohol have superior uniform tow dispersibility in an aqueous solution in the vicinity of pH 7, uniform tow dispersibility in acidic or alkaline aqueous solutions is inadequate. In addition, although carbon fibers imparted with water-soluble Nylon resin have superior uniform tow dispersibility in acidic aqueous solutions, their uniform tow dispersibility in neutral or alkaline aqueous solutions is inadequate.

As has been explained above, there are no conventional sizing agents having satisfactory solubility in water over a wide pH range, or which are able to simultaneously impart adequate convergence required for forming stable chopped carbon fibers, superior workability (e.g., processability) to carbon fiber when forming fabrics, and superior uniform tow dispersibility in water over a wide pH range.

DISCLOSURE OF INVENTION

A problem to be solved by the present invention is to provide a carbon fiber sizing agent that has satisfactory solubility in water over a wide pH range, and is able to impart to carbon fibers adequate convergence required for forming stable chopped carbon fibers, superior workability (e.g., processability) when forming fabrics, and satisfactory uniform tow dispersibility in water over a wide pH range.

In addition, another problem to be solved by the present invention is to provide a carbon fiber sizing method for carrying out effective sizing using the aforementioned sizing agent, sized carbon fibers treated with the aforementioned sizing agent, and a fabric that uses said carbon fibers.

The aforementioned problems can be solved by a carbon fiber sizing agent of the present invention composed in the manner described below, a carbon fiber sizing method that uses said sizing agent, sized carbon fibers and a fabric that uses said carbon fibers.

The carbon fiber sizing agent of the present invention is comprised of water-soluble thermoplastic resin and amphoteric surfactant within a weight ratio range of 6/1 to 1/3.

In the carbon fiber sizing agent of the present invention having the aforementioned constitution, the amphoteric surfactant is preferably a betaine type amphoteric surfactant, and particularly preferably an alkylimidazoline-based betaine type amphoteric surfactant.

Moreover, in the carbon fiber sizing agent of the present invention having the aforementioned constitution, the water-soluble thermoplastic resin is preferably a water-soluble Nylon resin.

The carbon fiber sizing method of the present invention is comprised of treating carbon fibers with a sizing liquid containing the carbon fiber sizing agent of the present invention having the aforementioned constitution.

The sized carbon fibers of the present invention are comprised by adhering the carbon fiber sizing agent of the present invention having the aforementioned constitution to their surfaces, and the present invention can be preferably applied to chopped carbon fibers in particular.

The fabric of the present invention uses the sized carbon fibers of the present invention having the aforementioned constitution in at least a portion thereof.

BEST MODE FOR CARRYING OUT THE INVENTION

[Carbon Fiber Sizing Agent]

The carbon fiber sizing agent of the present invention contains a water-soluble thermoplastic resin and an amphoteric surfactant, and the weight ratio of the water-soluble thermoplastic resin and amphoteric surfactant is within the range of 6/1 to 1/3. According to this composition, a carbon fiber sizing agent can be provided that has satisfactory solubility in water over a wide pH range, and is able to impart to carbon fibers adequate convergence required for forming into stable chopped carbon fibers, superior workability (e.g., processability) for forming a fabric, and satisfactory uniform tow dispersibility in water over a wide pH range.

Amphoteric surfactants used in combination with the aforementioned water-soluble thermoplastic resin include carboxylate type amphoteric surfactants and sulfonate type amphoteric surfactants. Since these amphoteric surfactants functions as anionic surfactants in alkaline aqueous solutions and cationic surfactants in acidic aqueous solutions, carbon fiber sizing agents containing such a surfactant have superior solubility in water over a wide pH range.

There are no particular restrictions on carboxylate type amphoteric surfactants, and carboxyamino acid type amphoteric surfactants and carboxybetaine type amphoteric surfactants can be used. In addition, examples of sulfonate type amphoteric surfactants that can be used include sulfobetaine type amphoteric surfactants.

The use of a betaine type amphoteric surfactant such as carboxybetaine type amphoteric surfactant or sulfobetaine type amphoteric surfactant is preferable since they are able to impart even more superior uniform tow dispersibility to carbon fibers. Moreover, they are also preferable since there is no decrease in hydrophilic properties at the isoelectric point (where anions and cations are in balance) as is observed with carboxyamino acid type amphoteric surfactants.

Furthermore, examples of carboxybetaine type amphoteric surfactants include alkyldimethyl betaine type, alkylamide-alkyl betaine type, alkylimidazoline betaine type and hydroxyalkylimidazoline betaine type amphoteric surfactants. Among these, the use of alkylimidazoline betaine type amphoteric surfactants makes it possible to impart particularly superior uniform tow dispersibility to carbon fibers.

The aforementioned amphoteric surfactant used in combination with the water-soluble thermoplastic resin may be only one type or a combination of a plurality of types.

There are no particular restrictions on water-soluble thermoplastic resins that can be used in the carbon fiber sizing agent of the present invention, examples of which include polyvinyl alcohol, water-soluble Nylon resin, water-soluble urethane resin, acrylamide resin, acrylamide-vinyl acetate copolymer resin, polyacrylic ester resin and methyl cellulose. Among these, the use of water-soluble Nylon resin is particularly preferable since carbon fibers can be obtained having superior convergence and uniform tow dispersibility in water.

In the carbon fiber sizing agent of the present invention containing water-soluble thermoplastic resin and amphoteric surfactant, together with imparting improving handling ease by imparting convergence to the carbon fibers, and as a result, imparting superior workability (e.g., processability) when forming into chopped carbon fibers or, fabric, the water-soluble thermoplastic resin also fulfills the function of improving uniform tow dispersibility in water. On the other hand, although not having a function that causes the carbon fibers to converge, the amphoteric surfactant fulfills the function of improving uniform tow dispersibility in water over a wide pH range.

Here, if the weight ratio of water-soluble thermoplastic resin and amphoteric surfactant is greater than 6/1, the uniform tow dispersibility of the carbon fibers in water tends to decrease. This is particularly prominent in pH regions where the dissolving performance of the water-soluble thermoplastic resin decreases. On the other hand, if the weight ratio of water-soluble thermoplastic resin and amphoteric surfactant is less than 1/3, adequate convergence is no longer able to be imparted to the carbon fibers, and processability and other workability when forming into chopped carbon fibers or fabric decreases. Thus, the weight ratio of water-soluble thermoplastic resin and amphoteric surfactant of the carbon fiber sizing agent of the present invention is required to be within the range of 6/1 to 1/3, and preferably within the range of 2/1 to 1/2.

In addition to the aforementioned water-soluble thermoplastic resin and amphoteric surfactant, nonionic surfactant, smoothing agent and so forth may also be added within a range that does not impair the object of the present invention.

In addition, an antifoaming agent may also be added to the carbon fiber sizing agent of the present invention for the purpose of inhibiting air bubbles formed when dispersing in water. In the carbon fiber sizing agent of the present invention, the amphoteric surfactant is a superior foaming agent and the water-soluble thermoplastic resin is a superior foam stabilizing agent since it is a high molecular weight compound. Consequently, when carbon fibers to which are adhered the carbon fiber sizing agent of the present invention are dispersed in water, the sizing agent dissolves in the water, and these compounds begin to act as foaming agents and foam stabilizing agent. Thus, there are many cases in which it is effective to add an antifoaming agent that dissipates the bubbles formed in advance.

There are no particular restrictions on antifoaming agents that can be used here, examples of which include silicone antifoaming agents, polyalkylene glycol antifoaming agents, higher alcohol emulsion antifoaming agents, metallic soap antifoaming agents and wax emulsion antifoaming agents. Specific examples include silicone oils, silicone resins, surfactant blends of these resins, polyethylene glycol fatty acid esters, pluronic type nonionic surfactants, polypropylene glycol and its derivatives, and acetylene glycol and its derivatives.

The carbon fibers to which the carbon fiber sizing agent of the present invention is applied may be carbon fibers obtained from various starting materials such as pitch, rayon and polyacrylonitrile. In addition, they may be a high-strength type (low elastic modulus carbon fibers), medium to high elasticity carbon fibers or ultra-high elasticity carbon fibers.

[Carbon Fiber Sizing Method]

The carbon fiber sizing method of the present invention uses a sizing liquid that contains the aforementioned carbon fiber sizing agent. This method can be carried out by contacting said sizing liquid with carbon fibers by a method such as roller immersion or roller contact followed by drying the carbon fibers. Here, a sizing liquid composed of the aforementioned sizing agent or a sizing liquid in which the aforementioned sizing agent is dispersed or dissolved in a water or an organic solvent such as acetone is used for the sizing liquid. However, the use of a sizing liquid composed of an aqueous solution is superior both industrially and in terms of safety in comparison with a sizing liquid that uses an organic solvent.

The amount of sizing agent that adheres to the surface of the carbon fibers as a result of sizing treatment can be regulated by adjusting the concentration and amount of pressing of the sizing liquid. In addition, drying can be carried out using hot air, hot plate, hot rollers or various types of infrared heaters.

[Sized Carbon Fibers]

The sized carbon fibers of the present invention have the aforementioned carbon fiber sizing agent adhered to their surfaces. The amount of sizing agent adhered to the carbon fibers should be an amount that imparts adequate convergence to the carbon fibers, results in satisfactory processability and other workability for forming chopped carbon fibers or fabric, and is able to impart superior uniform tow dispersibility in water. More specifically, the adhered amount is preferably 0.3 to 5.0% by weight, and more preferably 0.5 to 3.0% by weight, with respect to the weight of the carbon fibers.

In addition, the sized carbon fibers can be used to form chopped carbon fibers by cutting to a length of about 1 to 30 mm using a cutter such as a roving cutter or guillotine cutter.

[Fabric]

A fabric that uses the sized carbon fibers of the present invention is a fabric that at least uses in a portion therein sized carbon fibers provided with adequate convergence, demonstrate minimal generation of fuzzy due to mechanical friction and so forth, and have superior processability and other workability when formed into a fabric.

There are no particular restrictions on the knit or woven structure of the fabric of the present invention. In addition, a fabric of the present invention may be that which only uses the aforementioned sized carbon fibers as threads, or may be a mixed knitted blend or mixed woven blend of said carbon fibers with other fibers. Here, preferable examples of other fibers include inorganic fibers such as glass fibers, TYRANNO fibers and SiC fibers, and organic fibers such as aramid, polyester, PP, nylon, polyimide and vinylon fibers.

EXAMPLES

The following provides an explanation of the concrete constitutions of the carbon fiber sizing agent of the present invention, carbon fiber sizing method using said sizing agent, sized carbon fibers and fabric using said carbon fibers based on the examples.

Examples 1 to 9 and Comparative Examples 1 to 9

<Preparation of Carbon Fiber Sizing Agent>

The water-soluble thermoplastic resins (or their aqueous solutions) and the surfactants (or their aqueous solutions) shown in the following Table 1 were mixed as the weight ratios shown in Table 1 to obtain carbon fiber sizing agents as examples and comparative examples of the present invention. Furthermore, the weight ratios referred to here indicate the weight ratios of the pure components.

<Sizing Treatment>

Each of the resulting sizing agents was used as sizing liquids to treat carbon fibers.

Namely, each of the resulting sizing agents was filled into an immersion tank provided with free rollers inside. Subsequently, carbon fiber bundles (Mitsubishi Rayon Co., Ltd: "PYROFIL TR50SX", number of filaments: 12000, strand strength: 5,000 MPa, strand elastic modulus: 242 GPa) not imparted with sizing agent were immersed into the immersion tank. Following sizing treatment, the carbon fiber bundles were removed from the tank and dried with hot air to obtain sized carbon fiber bundles which were then wound onto bobbins.

The amounts (% by weight) of sizing agent adhered to each of the resulting sized carbon fiber bundles are shown in Table 2.

<Evaluation>

The sized carbon fiber bundles obtained in the manner described above were evaluated in the following manner. Those results are shown in Table 2.

(1) Uniform Tow Dispersibility

Each of the sized carbon fiber bundles were unwound from its bobbin and gently immersed in (a) aqueous nitric acid solution adjusted to pH 2, (b) ion exchange water adjusted to pH 7 and (c) aqueous calcium hydroxide solution adjusted to pH 12. The uniform tow dispersibility of the carbon fiber bundles at this time was evaluated according to the dispersibility index shown below. Furthermore, a dispersibility index of 3 or higher indicates satisfactory uniform tow dispersibility for carbon fibers.

Dispersibility Index:

0: No dispersion even at about 20 seconds after immersion
1: Dispersed about 20 seconds after immersion
2: Dispersed about 10 seconds after immersion
3: Dispersed about 5 seconds after immersion
4: Dispersed 2 to 3 seconds after immersion
5: Dispersed immediately after immersion (2) Workability of Chopped Carbon Fibers Each of the sized carbon fiber bundles were unwound from its bobbin and continuously cut to a length of 6 mm with a roving cutter to form chopped carbon fibers. The workability at this time was evaluated based on the following standards.

Evaluation standards:

O: No cutting errors and convergence of carbon fiber bundles maintained
X: Cutting errors occur or convergence of carbon fiber bundles decreases resulting in loosening of carbon fibers (3) Fabric Production The sized carbon fiber bundles were woven into a plain weave fabric having a total thread density of 6/inch and a width of 1 m by a rapier-type loom at a weaving speed of 40 cm/minute using each of the carbon fiber bundles as the weft and warp. The ease of fabric production at that time was evaluated based on the following standards.

Evaluation standards:

O: No fuzzy at the guides and so forth, no abnormal stopping of the loom, and no fuzzy on the surface of the fabric
X: Any occurrence of fuzzy at the guides and so forth, abnormal stoppage of the loom, or fuzzy on the surface of the fabric

TABLE 1

| | Water-soluble thermoplastic resin (or its aqueous solution) | Surfactant (or its aqueous solution) | Weight ratio |
|---|---|---|---|
| Example 1 | KP-2007 | Amphoteric surfactant A | 1/1 |
| Example 2 | KP-2007 | Amphoteric surfactant B | 1/1 |
| Example 3 | KP-2007 | Amphoteric surfactant C | 1/1 |
| Example 4 | KP-2007 | Amphoteric surfactant D | 1/1 |
| Example 5 | MARPOZOL S-50 | Amphoteric surfactant C | 2/1 |
| Example 6 | MARPOLOSE EM400 | Amphoteric surfactant C | 2/1 |
| Example 7 | KP-2021A | Amphoteric surfactant C | 1/1 |
| Example 8 | KP-2007 | Amphoteric surfactant C | 6/1 |
| Example 9 | KP-2007 | Amphoteric surfactant E | ½ |
| Comp. Ex. 1 | KP-2007 | — | — |
| Comp. Ex. 2 | KP-2007 | Nonionic surfactant | 1/1 |
| Comp. Ex. 3 | KP-2007 | Anionic surfactant | 1/1 |
| Comp. Ex. 4 | MARPOZOL A-200 | — | — |
| Comp. Ex. 5 | MARPOZOL S-50 | — | — |
| Comp. Ex. 6 | KP-2021A | — | — |
| Comp. Ex. 7 | KP-2007 | Amphoteric surfactant C | 7/1 |
| Comp. Ex. 8 | KP-2007 | Amphoteric surfactant C | ¼ |
| Comp. Ex. 9 | MARPOLOSE EM400 | — | — |

The meanings of the abbreviations used in the table are indicated below.

KP2007: 20% by weight aqueous solution of water-soluble nylon resin (Matsumoto Yushi-Seiyaku Co., Ltd., "KP-2007")

KP2021A: 10% by weight aqueous solution of water-soluble nylon resin (Matsumoto Yushi-Seiyaku Co., Ltd., "KP-2021A")

MARPOZOL A-200: Acrylamide-vinyl acetate copolymer resin (Matsumoto Yushi-Seiyaku Co., Ltd., "MARPOZOL A-200")

MARPOZOL S-50: Polyacrylic ester resin (Matsumoto Yushi-Seiyaku Co., Ltd., "MARPOZOL S-50")

MARPOLOSE EM400: Water-soluble methylcellulose resin (Matsumoto Yushi-Seiyaku Co., Ltd., "Marpolose EM400")

Amphoteric surfactant A: Alkyldimethyl betaine type amphoteric surfactant

Amphoteric surfactant B: Alkylamide-alkylbetaine type amphoteric surfactant

Amphoteric surfactant C: Alkylimidazoline betaine type amphoteric surfactant

Amphoteric surfactant D: Hydroxyalkylimidazoline betaine type amphoteric surfactant Amphoteric surfactant E: Alkylaminoalkylamide diethyl sulfate Nonionic surfactant: Polyoxyethylene alkyl ether Anionic surfactant: Phosphate-based anionic surfactant

TABLE 2

| | Adhered amt. of sizing agent | Uniform tow dispersibility in water | | | Chopped carbon fiber work- | Ease of fabric produc- |
|---|---|---|---|---|---|---|
| | (wt %) | pH 2 | PH 7 | pH 12 | ability | tion |
| Ex. 1 | 3.0 | 4 | 3 | 4 | ○ | ○ |
| Ex. 2 | 3.0 | 4 | 3 | 4 | ○ | ○ |
| Ex. 3 | 3.0 | 5 | 4 | 5 | ○ | ○ |
| Ex. 4 | 3.0 | 4 | 4 | 4 | ○ | ○ |
| Ex. 5 | 3.0 | 3 | 3 | 4 | ○ | ○ |
| Ex. 6 | 2.0 | 3 | 4 | 3 | ○ | ○ |

TABLE 2-continued

| | Adhered amt. of sizing agent | Uniform tow dispersibility in water | | | Chopped carbon fiber work- | Ease of fabric produc- |
|---|---|---|---|---|---|---|
| | (wt %) | pH 2 | PH 7 | pH 12 | ability | tion |
| Ex. 7 | 3.0 | 4 | 3 | 3 | ○ | ○ |
| Ex. 8 | 1.2 | 3 | 3 | 3 | ○ | ○ |
| Ex. 9 | 3.0 | 3 | 2 | 2 | ○ | ○ |
| Comp. Ex. 1 | 1.5 | 2 | 1 | 1 | ○ | ○ |
| Comp. Ex. 2 | 3.0 | 2 | 1 | 1–2 | ○ | ○ |
| Comp. Ex. 3 | 3.0 | 0 | 0 | 0 | ○ | ○ |
| Comp. Ex. 4 | 1.5 | 1 | 2 | 1 | X decreased convergence | X fuzzy |
| Comp. Ex. 5 | 1.5 | 0 | 1 | 2 | X decreased convergence | X fuzzy |
| Comp. Ex. 6 | 1.5 | 1 | 1 | 0 | ○ | ○ |
| Comp. Ex. 7 | 1.4 | 2 | 1 | 1 | ○ | ○ |
| Comp. Ex. 8 | 4.0 | 5 | 4 | 5 | X decreased convergence | X fuzzy |
| Comp. Ex. 9 | 0.6 | 1 | 2 | 1 | X decreased convergence | X fuzzy |

As shown in Tables 1 and 2, in Examples 1 through 9 in which carbon fiber sizing agents were prepared containing water-soluble thermoplastic resin and amphoteric surfactant and having weight ratios of water-soluble thermoplastic resin and amphoteric surfactant ranging from 6/1 to 1/3, the sized carbon fiber bundles exhibited superior uniform tow dispersibility in water over a wide pH range. In addition, workability when formed into chopped carbon fibers and ease of fabric production were satisfactory.

In contrast, in Comparative Examples 1,4 to 6 and 9, which were not blended with a surfactant itself, Comparative Examples 2 and 3, which were blended with a surfactant but not an amphoteric surfactant, and Comparative Examples 7 and 8, which were blended with an amphoteric surfactant, but the weight ratio of water-soluble thermoplastic resin and amphoteric surfactant was outside the range of 6/1 to 1/3, carbon fiber bundles that satisfied all the requirements of uniform tow dispersibility, workability when formed into chopped carbon fibers and ease of fabric production were unable to be obtained despite having undergone sizing treatment.

INDUSTRIAL APPLICABILITY

As has been explained above, the carbon fiber sizing agent of the present invention has satisfactory solubility in water over a wide pH range, and simultaneous to imparting to the carbon fibers adequate convergence required for forming into stable chopped carbon fibers and superior workability (e.g., processability) when forming into a fabric, it is also able to impart superior uniform tow dispersibility in water over a wide pH range.

In addition, the carbon fiber sizing method of the present invention is carried out by using a sizing liquid that contains the aforementioned carbon fiber sizing agent of the present invention, and simultaneous to imparting to the carbon fibers adequate convergence required for forming into stable chopped carbon fibers and superior workability (e.g., processability) when forming into a fabric, it is also able to impart superior uniform tow dispersibility in water over a wide pH range.

Moreover, the sized carbon fibers of the present invention are those in which the aforementioned sizing agent of the present invention is adhered to their surfaces, and are provided with adequate convergence required when forming into stable chopped carbon fibers and superior workability (e.g., processability) when forming into a fabric, while also being provided with superior uniform tow dispersibility in water over a wide pH range.

Moreover, since a fabric that uses the sized carbon fibers of the present invention demonstrates affinity to water over a wide pH range, it is suitable for applications such as immersing said fabric in an aqueous matrix in order to impregnate the fabric with that matrix.

Furthermore, the present invention can be carried out in various other forms without deviating from its major characteristics. The aforementioned modes for carrying out the present invention merely indicate examples thereof, and should not be understood to limit the invention in any way. In addition, the scope of the present invention indicates the scope of claim for patent, and is not constrained in any manner by the text of the description. In addition, all variations and modifications falling within the equivalent scope of claim for patent are included within the scope of claim for patent.

The invention claimed is:

1. A carbon fiber sizing agent, comprising:

a water-soluble thermoplastic resin and an alkylimidazoline-based betaine-type amphoteric surfactant combined in a weight ratio ranging from 6/1 to 1/3.

2. The carbon fiber sizing agent according to claim 1, wherein a water-soluble thermoplastic resin is a water-soluble nylon resin.

3. The carbon fiber sizing agent according to claim 1, wherein the weight ratio range of water-soluble thermoplastic resin to amphoteric surfactant ranges from 2/1 to 1/2.

4. The carbon fiber sizing agent according to claim 1, wherein the water soluble thermoplastic resin is polyvinyl alcohol, water soluble Nylon resin, water soluble urethane resin, acrylamide resin, acrylamide-vinyl acetate copolymer resin, polyacrylic ester resin or methyl cellulose.

5. A method of sizing carbon fibers, comprising:

treating carbon fibers with a sizing liquid containing the carbon fiber sizing agent according to claim 1.

6. Sized carbon fibers, comprising:

carbon fibers whose surfaces have the carbon fiber sizing agent according to claim 1 adhered thereto.

7. The sized carbon fibers according to claim 6, wherein the carbon fibers are chopped carbon fibers.

8. A fabric comprising the sized carbon fibers according to claim 6.

* * * * *